US005326222A

United States Patent [19]

Matyscak et al.

[11] Patent Number: 5,326,222

[45] Date of Patent: Jul. 5, 1994

[54] BEARING ARRANGEMENT FOR A THERMAL TURBO MACHINE

[75] Inventors: Kamil Matyscak, Uehlingen-Brenden, Fed. Rep. of Germany; Michael Müller, Lengnau, Switzerland

[73] Assignee: Asea Brown Boveri Ltd., Baden, Switzerland

[21] Appl. No.: 89,621

[22] Filed: Jul. 12, 1993

Related U.S. Application Data

[63] Continuation of Ser. No. 800,017, Nov. 29, 1991, abandoned.

[30] Foreign Application Priority Data

Dec. 10, 1990 [EP] European Pat. Off. ..... 90123734.7

[51] Int. Cl.[5] ..... F01D 25/00

[52] U.S. Cl. ..... 415/213.1; 415/133; 415/142; 248/638; 384/267; 384/583

[58] Field of Search ..... 415/129, 130, 132, 133, 415/142, 213.1; 384/519, 583, 267; 248/638, 595, 592

[56] References Cited

U.S. PATENT DOCUMENTS

| | | | |
|---|---|---|---|
| 848,224 | 3/1907 | Clough | 384/267 |
| 1,466,930 | 9/1923 | Cipra | 384/267 |
| 2,724,621 | 11/1955 | Kenney, Jr. | 384/519 |
| 2,929,592 | 3/1960 | Spaetgens | 248/638 |
| 3,261,587 | 7/1966 | Rowley . | |
| 4,076,452 | 2/1978 | Hartmann . | |
| 4,150,588 | 4/1979 | Brewer | 248/638 |
| 4,204,804 | 5/1980 | Woodger | 415/213.1 |
| 4,744,726 | 5/1988 | Remberg | 415/213.1 |
| 5,094,588 | 3/1992 | Gros | 415/213.1 |
| 5,106,264 | 4/1992 | Gros | 415/213.1 |
| 5,108,258 | 4/1992 | Gros | 415/213.1 |
| 5,178,357 | 1/1993 | Platus | 248/638 |

FOREIGN PATENT DOCUMENTS

| | | | |
|---|---|---|---|
| 0395110 | 10/1990 | European Pat. Off. . | |
| 768036 | 12/1937 | Fed. Rep. of Germany . | |
| 639666 | 5/1962 | Italy | 248/638 |
| 153836 | 6/1989 | Japan | 248/638 |

*Primary Examiner*—John T. Kwon

*Attorney, Agent, or Firm*—Oblon, Spivak, McClelland, Maier & Neustadt

[57] ABSTRACT

In an axial flow gas turbine, the outlet blading followed by an exhaust casing (5) whose boundary walls essentially comprise a ring-shaped inner part (6) at the hub and a ring-shaped outer part (7) which delimit a diffusor (9). The outlet-end bearing arrangement (4, 11) of the turbomachine is arranged in the hollow space within the inner part. The bearing casing (11) can be repositioned by adjustment elements (12) arranged on the inner part (6) of the exhaust casing and is supported on the foundation via at least one sprung support (15).

6 Claims, 1 Drawing Sheet

BEARING ARRANGEMENT FOR A THERMAL TURBO MACHINE

This application is a continuation of U.S. patent application Ser. No. 07/800,017, filed on Nov. 29, 1991, now abandoned.

BACKGROUND OF THE INVENTION

1. Field of the Invention

The invention concerns a thermal turbomachine, in particular an axial flow gas turbine, whose outlet blading is followed by an exhaust casing whose boundary walls essentially comprise a ring-shaped inner part at the hub and a ring-shaped outer part which delimit a diffusor and are connected to each other by a plurality of ribs uniformly distributed over the circumference, the outlet-end bearing arrangement of the turbomachine being arranged in the hollow space within the inner part.

In the case of stationary gas turbine installations, relatively long outlet diffusors are provided, preferably extending in the axial direction, for reasons of fluid mechanics and the better to influence the efficiency. As a result, it is necessary to arrange the exhaust-end turbine runner bearing in the diffusor structure itself. Because of the differing requirements of the diffusor casing, which should be free to expand, and the turbine runners, which cannot be allowed to move about, problems arise which have previously been solved in various ways.

2. Discussion of Background

Thus, for example, in the diffusor of a jet engine gas turbine, which is connected via streamlined ribs to an outer casing, it is known from U.S. Pat. No. 3,261,587 to support the load-bearing ring of the shaft bearing on the outer casing by pins inserted in a thermally mobile fashion in radial planes in the diffusor. Consequently, both the dominant dynamic forces and the expansion forces of the exhaust diffusor are transferred to the outer casing. The outer casing itself is supported on the foundation via claws or suspension supports.

In unsteady operation, as often occurs, for example, in the case of power station gas turbines used for peak-load supply, the casings are subject to thermal stresses and differential expansions which lead to variations in clearance between casing and runner and can also affect the shaft bearing arrangement. Damage to the bearings and stuffing boxes as well as blading damage can then arise. In particular, these disadvantages become effective to a greater extent in today's modern machines with their large dimensions and high temperatures.

An early solution, in which the exhaust diffusor was separated completely from the outer casing of the gas turbine, is known from DE-C-768,036. The outer and inner ring walls of the diffusor are connected together via thermally mobile and expansion compensating elements and the end bearing of the runner is supported in the interior of the inner wall at the hub. Shaft movements can also occur with this type of construction as a result of differential expansions. In particular, large thermal stresses occur at the thermally mobile joints between the exhaust diffusor and the exhaust casing, complicating the sealing problems prevailing there.

In modern machines, the diffusor is no longer itself supported directly on the foundation but is flanged onto the gas turbine casing. The exhaust-end shaft bearing arrangement within the diffusor inner ring is located in an exceptionally hot environment when the machine is operating. Both the positioning of the bearing and the acceptance of the normally vertical load are located in the diffusor structure However, because of the low creep rupture strength of the materials used, the whole load-bearing structure can deform in the course of time.

SUMMARY OF THE INVENTION

Accordingly, one object of the invention is to provide a novel means for turbomachinery of the type mentioned at the beginning whereby the support of the outlet-end bearing arrangement is independent of the effects of thermal loading and the thermal expansion of the casing and the diffusor walls.

In accordance with the invention this is achieved when the bearing casing can be repositioned by means of adjustment elements arranged on the inner part of the exhaust casing and is supported on the foundation via at least one spring support.

Although, in the case of a gas turbine, U.S. Pat. No. 4,076,452 discloses the transfer of the exhaust-end bearing forces via supports from the diffusor interior into the foundation, it is concerned with thermally sensitive rigid supports, with cooling medium flowing around or through them, on the one hand, and protected against the temperature prevailing in the diffusor interior by insulation material, on the other. In addition, the bearing itself has no kind of effective connection to the diffusor walls.

The particular advantage of the invention can be seen in the fact that while deformation of the diffusor caused by shaft loading is excluded, the diffusor nevertheless positions the rotor in the outer casing. Thus, radial blade clearances in the turbomachine remain undisturbed when, for example, the casing sinks.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein, for a gas turbine with axial/axial outlet.

DESCRIPTION OF THE PREFERRED EMBODIMENTS

Figure 1:
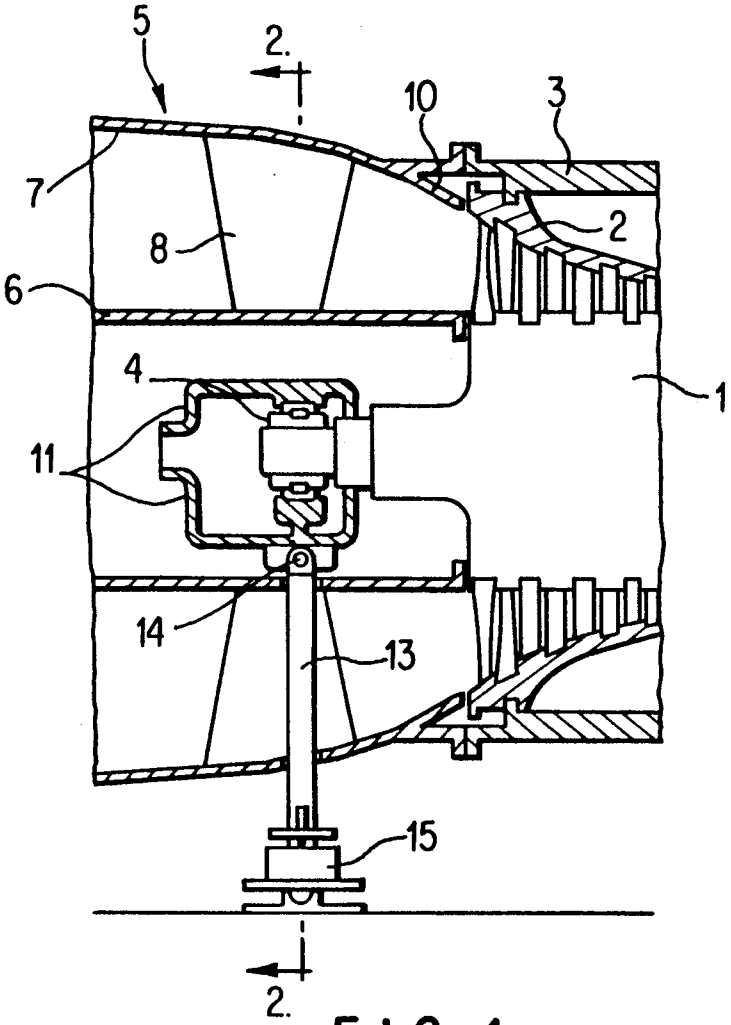
FIG. 1 shows a longitudinal cross section of a gas turbine with bearing support in accordance with the invention.

Referring now to the drawings, wherein like reference numerals and letters designate identical or corresponding parts throughout the several views, only the elements essential for understanding the invention are shown. Those components of the facility not shown include, for example, the compressor, the combustion chamber, the complete exhaust duct and the chimney. The flow direction of the working medium is denoted by arrows.

Figure 2:
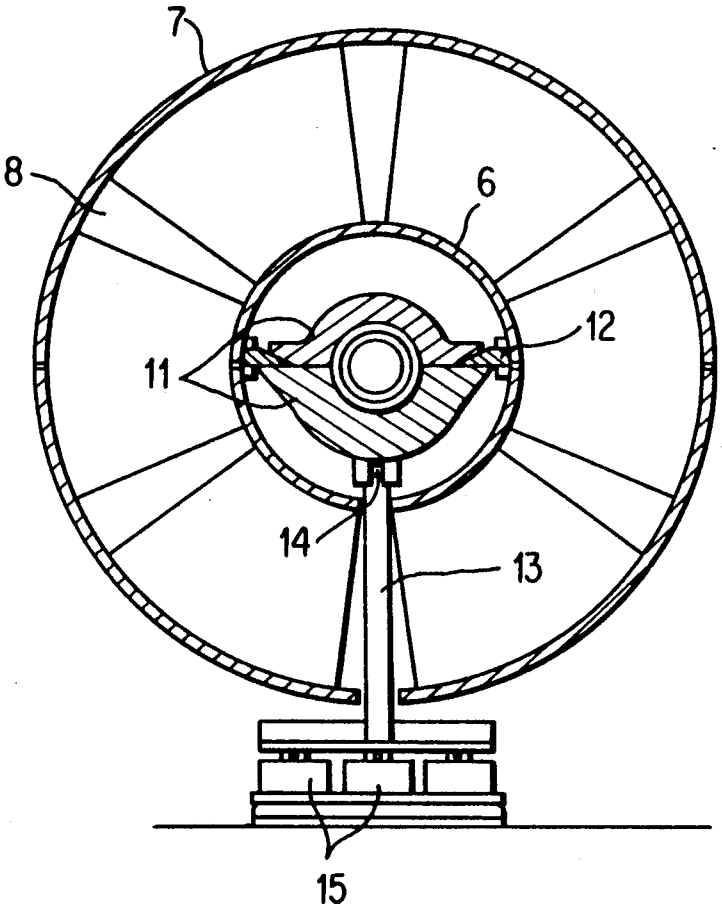
FIG. 2 shows a cross section through the diffusor along line 2—2 in FIG. 1.

The thermal turbomachine, here a gas turbine, of which the exhaust end and the last four, axial-flow stages are shown in FIG. 1, essentially comprises the bladed rotor 1 and the blade ring 2 fitted with nozzle guide blades. The blade ring is suspended inside the turbine casing 3. The exhaust duct 5 is flanged onto the turbine casing and essentially comprises a ring-shaped inner part 6 at the line and a ring-shaped outer part 7 which delimit the diffusor 9. The two elements 6 and 7 can be half-shells with an axial plane of separation (FIG. 2, flanges not shown) or single-piece pot-type casings. They are connected together by a plurality of welded radial streamlined ribs 8 uniformly distributed over the circumference. At the turbine end, the ring-shaped outer part 7 is provided with a ring-shaped sealing strip 10, which is flush with the cylinder-end contour of the turbine duct flowed through.

The outlet-end bearing arrangement of the turbomachine is arranged in the hollow space inside the inner part 6. The rotor 1 is supported in a thrust bearing 4, whose bearing casing 11 is positioned by means of adjustment elements 12 (FIG. 2) which are a component part of the inner part 6. Since the exhaust duct flanged onto the turbine casing can be regarded as a rigid extension to the casing, this adjustment means 12 is sufficient for adjusting the bearing, rendering superfluous any further aids to ensure the maintenance of the line of the bearing.

In order to separate the functions of "positioning" and "load acceptance", the bearing load is now no longer accepted by the diffusor structure but is led out of the hot diffusor region. This is achieved by means of a strut 13, which is secured at its upper end by conventional means, for example a pin-joint 14, to the lower part of the bearing housing 11; at its lower end, the strut is connected to a commercially available sprung support 15 standing on the foundation. The ribs 8 in the diffusor 9 preferably have an aerodynamic profile and are of hollow design. The strut 13 is led through the lower vertical rib.

The sprung support 15 is able to accept thermal expansions of the strut 13 while the load remains constant. This ensures that the line of the bearing is not impaired. Since the thrust element of such a sprung support is usually a helical spring with a very flat spring characteristic, a certain coil height is necessary for it to exercise its compensation function. In the absence of sufficient free space between the exhaust duct and the foundation, the bearing load, which in the case of today's machines can easily be of the order of approximately 30 tons, is therefore distributed between a number of sprung supports 15, three in this instance.

The measure described has the advantage that the diffusor structure flanged onto the turbine casing can now be of lighter design since it is freed from the bearing load. In particular, this provides savings in expensive heat-resistant material.

The invention is not, of course, confined to the exemplary embodiment shown and described, which has as its subject matter a diffusor with axial outlet, significantly simplifying the arrangement of streamlined ribs for carrying the bearing support.

As a departure from the solution shown, using sprung supports, it could be just as effective to use so-called constant supports. In addition, it is readily conceivable to transmit the bearing load via sprung suspension units or constant suspension units into a hoop structure spanning the exhaust duct, instead of via supports acting directly on the foundation. In this case, the tie then connected to the bearing housing could be led through the upper vertical rib within the diffusor.

The invention is also fundamentally applicable in any situation where a machine component operating in a hot environment must be fixed in an absolute position.

Obviously, numerous modifications and variations of the present invention are possible in light of the above teachings. It is therefore to be understood that within the scope of the appended-claims, the invention may be practised otherwise than as specifically described herein.

What is claimed as new and desired to be secured by Letters Patent of the United States is:

1. A thermal turbomachine having an outlet blading followed by an exhaust casing comprising:

a ring-shaped inner part and a ring-shaped outer part which delimit a diffuser;

a plurality of ribs connecting said ring-shaped inner and outer parts, said plurality of ribs uniformly distributed about circumferences of the inner and outer parts;

an outlet-end bearing arrangement including a bearing casing arranged in a hollow space within the ring-shaped inner part;

adjustment elements arranged inside of and connected to the ring-shaped inner part of the exhaust casing for positioning the bearing casing;

support means for supporting said bearing casing, said support means extending through both of said ring-shaped inner part and said ring-shaped outer part, said support means mounted upon a foundation such that said bearing casing is supported upon said foundation;

wherein the ring-shaped outer part of said exhaust casing is flanged to a housing of the thermal turbomachine, and further wherein exhaust flows through said diffuser from an upstream end to a downstream end, and said ring-shaped outer part is flanged to the housing of the thermal turbomachine at said upstream end; and each of said ring-shaped inner part and said ring-shaped outer part extending in an axial direction from said upstream end, at which said ring-shaped outer part is flanged to said housing, to a location downstream of said bearing casing.

2. The turbomachine of claim 1, wherein the support means includes a strut connected to said bearing casing, said strut extending through the exhaust casing and through a hollow rib provided in the casing, and said strut is connected to a bottom part of said bearing casing wherein said strut extends vertically to support the bearing casing at said bottom part of the bearing casing said support means further including a spring mounted on said foundation disposed below the bearing casing, and wherein said strut is connected to said spring and extends vertically from said spring to said bottom part of said bearing casing.

3. The thermal turbomachine of claim 1, wherein said support means supports the entire load of said bearing casing such that said ring-shaped inner part and said ring-shaped outer part are not loaded by said bearing casing, and wherein said ring-shaped inner part and ring-shaped outer part are supported by said support means by way of said adjustment elements connecting said ring-shaped inner part and said bearing casing, and by way of said ribs connecting said ring-shaped outer part to said ring-shaped inner part.

4. The thermal turbomachine of claim 2, wherein said strut is connected to said bearing casing at a vertically lowermost point of said bearing casing.

5. A thermal turbomachine comprising:

turbine casing;

ring-shaped inner part connected to said thermal turbomachine;

an outlet-end bearing arrangement including a bearing casing arranged within the ring-shaped inner part;

a ring-shaped, outer part connected to said turbine casing at a flange, wherein exhaust flows through said ring-shaped outer part from an upstream end to a downstream end, and wherein said ring-shaped outer part is connected to said turbine casing at said flange at said upstream end;

a plurality of ribs connecting said ring-shaped inner part to said ring-shaped outer part, wherein an interior of said ring-shaped inner part is isolated from the exterior of said ring-shaped inner part by said ring-shaped inner part, and wherein a diffuser is delimited between said ring-shaped inner part and said ring-shaped outer part;

wherein at least some of said plurality of ribs are enclosed between said ring-shaped inner part and said ring-shaped outer part;

at least one of said plurality of ribs including an opening extending therethrough with said ring-shaped inner part and said ring-shaped outer part each including an opening extending therethrough at a location of said at least one of said plurality of ribs having an opening extending therethrough;

a support extending through said at least one of said plurality of ribs having an opening extending therethrough, said support also extending through the opening of each of said ring-shaped inner part and the ring-shaped outer part, said support connected to said bearing, and wherein said support is supported upon a foundation, whereby said bearing is supported upon said foundation by said support such that said ring-shaped inner part and said ring-shaped outer part are not loaded by said bearing casing;

means for absorbing thermal expansion of said support; and each of said ring-shaped inner part and said ring-shaped outer part extending in an axial direction from said upstream end, at which said ring-shaped outer part is connected to said housing, to a location downstream of said bearing casing.

6. The thermal turbomachine of claim 5, wherein said support includes a strut, and wherein said means for absorbing thermal expansion includes a spring disposed between said strut and said foundation.

* * * * *